US010088856B2

(12) United States Patent
Xu et al.

(10) Patent No.: US 10,088,856 B2
(45) Date of Patent: Oct. 2, 2018

(54) METHODS AND APPARATUS FOR NEGATIVE OUTPUT VOLTAGE ACTIVE CLAMPING USING A FLOATING BANDGAP REFERENCE AND TEMPERATURE COMPENSATION

(71) Applicant: Texas Instruments Incorporated, Dallas, TX (US)

(72) Inventors: Alvin Xu, Jiangsu (CN); Qingjie Ma, Shanghai (CN); Yang Wang, Shanghai (CN); Yan He, Shanghai (CN); Jun Ma, Shanghai (CN); Zhenghao Cui, Beijing (CN); Jingwei Xu, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 15/588,089

(22) Filed: May 5, 2017

(65) Prior Publication Data

US 2018/0181151 A1 Jun. 28, 2018

Related U.S. Application Data

(63) Continuation of application No. PCT/CN2016/112125, filed on Dec. 26, 2016.

(51) Int. Cl.

| | |
|---|---|
| ***G05F 1/56*** | (2006.01) |
| ***G05F 1/567*** | (2006.01) |
| ***G05F 3/30*** | (2006.01) |

(52) U.S. Cl.

CPC ..... *G05F 1/56* (2013.01); *G05F 1/567* (2013.01); *G05F 3/30* (2013.01)

(58) Field of Classification Search

CPC ..... G05F 1/567; G05F 3/30
USPC ..... 323/313
See application file for complete search history.

(56) References Cited

U.S. PATENT DOCUMENTS

| | | | | |
|---|---|---|---|---|
| 6,677,808 | B1 * | 1/2004 | Sean | G05F 3/30 323/313 |
| 7,639,067 | B1 * | 12/2009 | Perisetty | H02M 3/073 326/41 |
| 2013/0033305 | A1 * | 2/2013 | Fukazawa | G05F 1/567 327/539 |
| 2017/0160764 | A1 * | 6/2017 | Suzuki | G05F 1/468 |
| 2018/0076810 | A1 * | 3/2018 | Hietala | H03K 17/223 |

* cited by examiner

*Primary Examiner* — Timothy J Dole
*Assistant Examiner* — Ishrat Jamali
(74) *Attorney, Agent, or Firm* — Lawrence J. Bassuk; Charles A. Brill; Frank D. Cimino

(57) ABSTRACT

Methods, apparatus, systems and articles of manufacture for negative output voltage active clamping using a floating bandgap reference and temperature compensation are disclosed. An example load switch includes a floating bandgap reference circuit to generate a bandgap reference voltage. A resistor divider is to generate a resistor divider voltage. A temperature compensator to apply a temperature compensation current to the resistor divider to create a temperature compensated resistor divider voltage. A power transistor is to be enabled when the temperature compensated resistor divider voltage is less than the bandgap reference voltage. The example load switch can work under negative output voltage clamping and get better accuracy drain to source clamped voltage of power transistor for inductive load condition.

14 Claims, 8 Drawing Sheets

METHODS AND APPARATUS FOR NEGATIVE OUTPUT VOLTAGE ACTIVE CLAMPING USING A FLOATING BANDGAP REFERENCE AND TEMPERATURE COMPENSATION

This application is a Continuation of China PCT Application No. PCT/CN2016/112125, filed Dec. 26, 2017, currently pending.

FIELD OF THE DISCLOSURE

This disclosure relates generally to power control circuitry, and, more particularly, to methods and apparatus for negative output voltage active clamping using a floating bandgap reference and temperature compensation.

BACKGROUND

Load switches are switches that are used to supply power from a power source (e.g., a battery) to a load. In some examples, a load switch is implemented using a transistor such that a control signal can be provided to the transistor to connect or disconnect the power source to the load. In some examples, when a load switch is controlled to cease providing power to an inductive load, energy in the inductive load might pull its source to a very negative voltage level, placing the transistor (i.e., the load switch) into a breakdown mode. When the transistor is operating in the breakdown mode, the transistor may become damaged and cease to function as intended.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Load switches are switches that are used to supply power from a power source (e.g., a battery) to a load. Load switches may be implemented in a high-side fashion or a low-side fashion. High-side load switches are positioned intermediate a power source and a load, whereas low-side switches are positioned intermediate the load and a ground. When the load switch sources (high-side) and/or sinks (low-side) power to or from an inductive load, a control that instructs a load switch to cease sourcing (high-side) or sinking (low-side) power to or from the load, energy kept in the inductive load might pull the load switch to a negative voltage (high-side) or a positive voltage (low-side). Such negative voltages can, in some examples, cause damage to the load switch. Circuit designers seek to supplement circuitry within the load switch such that damage can be avoided.

Figure 1:
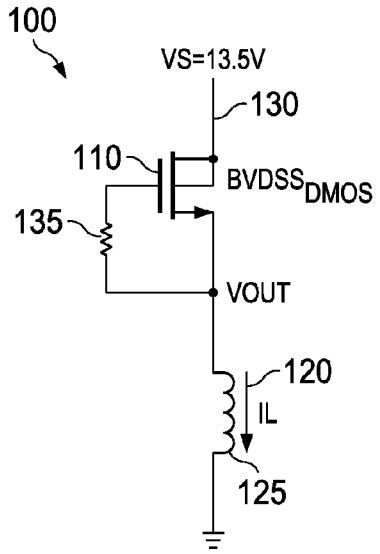
FIG. 1 is a circuit diagram illustrating a high-side transistor sourcing current to an inductive load.

FIG. 1 is a circuit diagram illustrating a high-side transistor 110 sourcing current 120 to an inductive load 125. In the illustrated example of FIG. 1, the transistor 110 is implemented using a double diffused metal-oxide-semiconductor (DMOS) transistor. However, any other type of transistor may additionally or alternatively be used. In the illustrated example of FIG. 1, a first terminal of the transistor 110 is connected to a source 130. In the illustrated example of FIG. 1, a second terminal of the transistor 110 is connected to the inductive load 125. In the illustrated example of FIG. 1, a third terminal of the transistor 110 is connected to the second terminal of the transistor via a resistor 135. In examples disclosed herein, the first terminal is a drain, the second terminal is a source, and the third terminal is a gate. However, any other transistor using any other past, present, and/or future terminal configuration and/or naming convention may additionally or alternatively be used.

Figure 2:
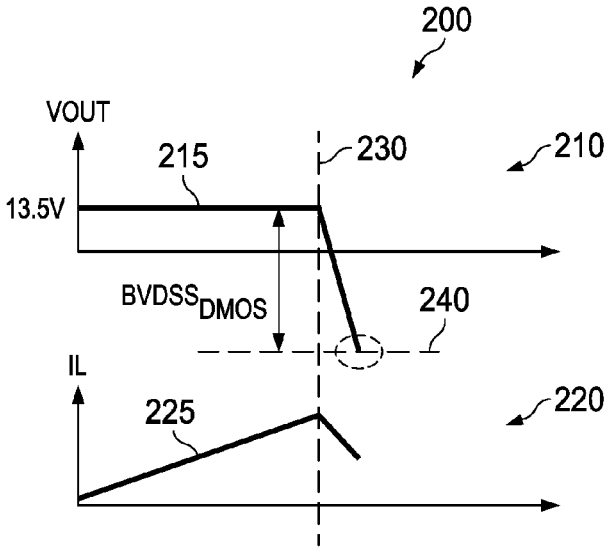
FIG. 2 is a voltage and current timing diagram illustrating changes in voltage and current when the high-side transistor of FIG. 1 is switched from an on state to an off state.

FIG. 2 is a voltage and current timing diagram 200 illustrating changes in voltage and current when the high-side transistor 110 of FIG. 1 is switched from an ON state to an OFF state. A voltage diagram 210 represents the voltage (VOUT) 215 at the second terminal of transistor 110 of FIG. 1 over time. A current diagram 220 represents the current (IL) 225 supplied to the load 125 of FIG. 1 over time. A vertical line 230 indicates a point in time when the transistor 110 is turned from an ON state (to the left of the vertical line 230) to an OFF state (to the right of the vertical line 230). When switched from the ON state to the OFF state, the voltage 215 is pulled to a negative value. In the illustrated example of FIG. 2, the negative voltage value reaches a breakdown voltage 240. As used herein, the breakdown voltage is a level at which a transistor ceases to operate in a normal mode. Once the breakdown voltage is reached, the transistor may subsequently fail to operate as expected.

Figure 3:
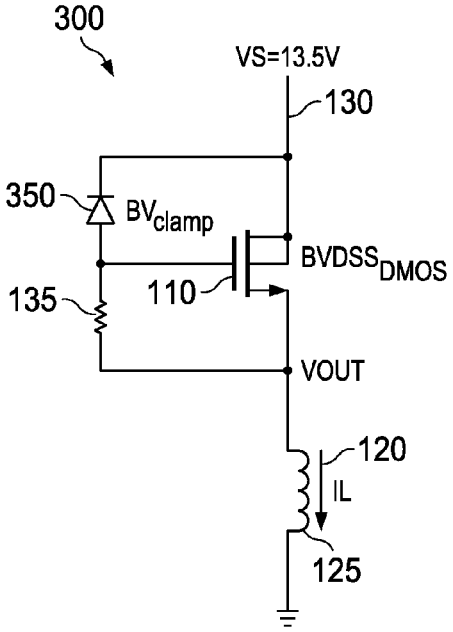
FIG. 3 is a circuit diagram illustrating a high-side transistor sourcing current to an inductive load and having a voltage clamping diode.

FIG. 3 is a circuit diagram illustrating the high-side transistor 110 sourcing current to the inductive load 125 and having a voltage clamping diode 350. The voltage clamping diode 350 places a clamp between the first terminal of the transistor 110 and the third terminal of the transistor 110 (e.g., between the drain and the gate of the transistor 110). In examples disclosed herein, the clamping voltage of the voltage clamping diode 350 is less than the breakdown voltage of the transistor 110. As a result, the voltage clamping diode 350 turns the transistor 110 ON before the voltage at the second terminal (e.g., the source of the transistor 110) reaches the breakdown voltage.

Figure 4:
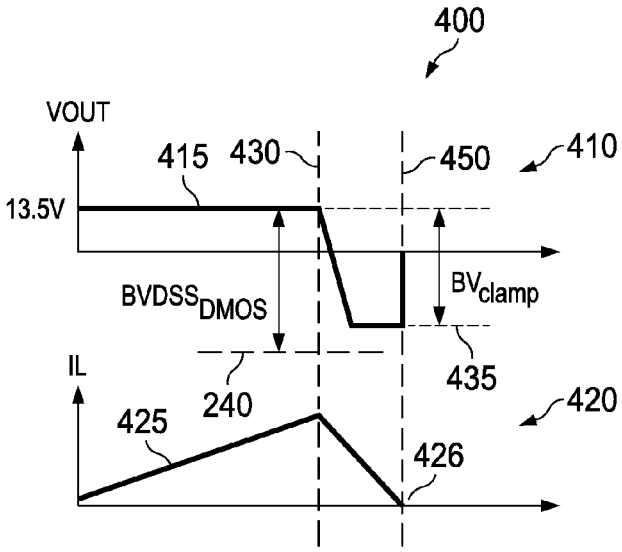
FIG. 4 is a voltage and current timing diagram illustrating changes in voltage and current when the high-side transistor of FIG. 3 is switched from an on state to an off state.

FIG. 4 is a voltage and current timing diagram illustrating changes in voltage and current when the high-side transistor 110 of FIG. 3 is switched from an ON state to an OFF state. A voltage diagram 410 represents the voltage ($V_{OUT}$) 415 at the second terminal of transistor 110 of FIG. 3 over time. A current diagram 420 represents the current ($I_L$) 425 supplied to the load 125 of FIG. 3 over time. A first vertical line 430 indicates a point in time when the transistor 110 is turned from an ON state (to the left of the vertical line 430) to an OFF state (to the right of the vertical line 430). When switched from the ON state to the OFF state, the voltage 415 is pulled downward (e.g., negatively). In the illustrated example of FIG. 4, the voltage value reaches the clamping voltage 435 of the voltage clamping diode 350, and does not reach the breakdown voltage 240. The voltage 415 is held at the clamping voltage 435 until the current ($I_L$) 425 supplied to the load 125 reaches a zero crossing 426, represented by a second vertical line 450. The voltage 415 is then returned to zero.

Example approaches for clamping the negative voltage value described in FIGS. 3 and/or 4 can encounter problems. For example, the values of the clamping voltage 435 of the voltage clamping diode 350 and the breakdown voltage 240 of the transistor 110 typically exhibit wide variations based on manufacturing processes and/or temperature. Circuit designers typically address that issue by selecting components that have operating ranges that are compatible with each other. For example, a circuit designer might select a 65V transistor (e.g., having a breakdown voltage of −69V), and a 40V transistor as the clamping diode (e.g., having a clamping voltage in the range of −44V and −68V). However, such components are typically large and/or expensive. Moreover, in some scenarios, while the gate and source of the transistor 110 meet a negative voltage, many components cannot survive at a negative operating voltage.

Figure 5:
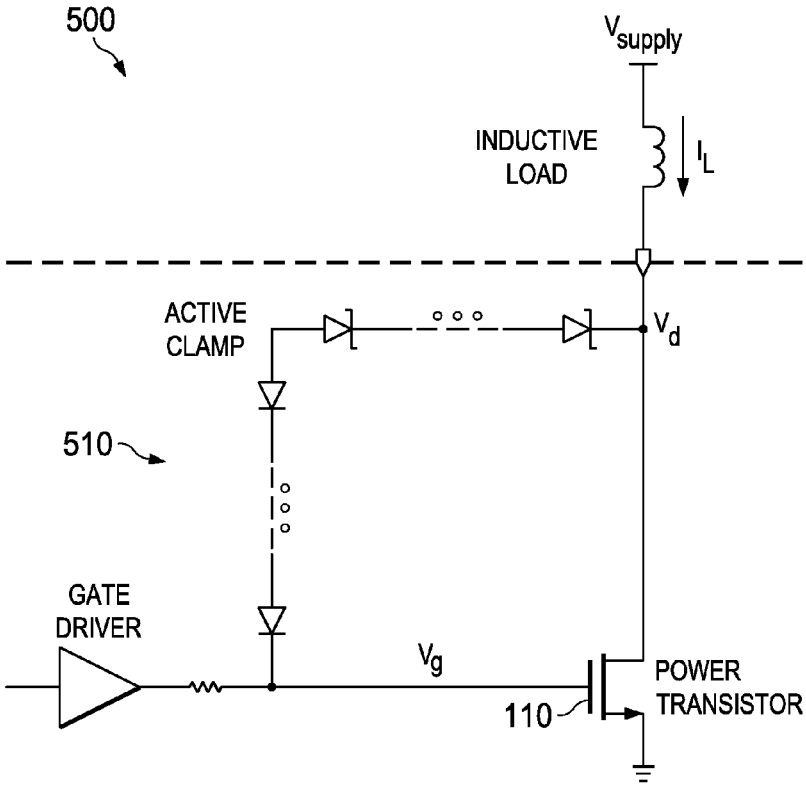
FIG. 5 is a circuit diagram of an example integrated gate-drain diode stack active clamping circuit used with a low-side load switch.
Figure 6:
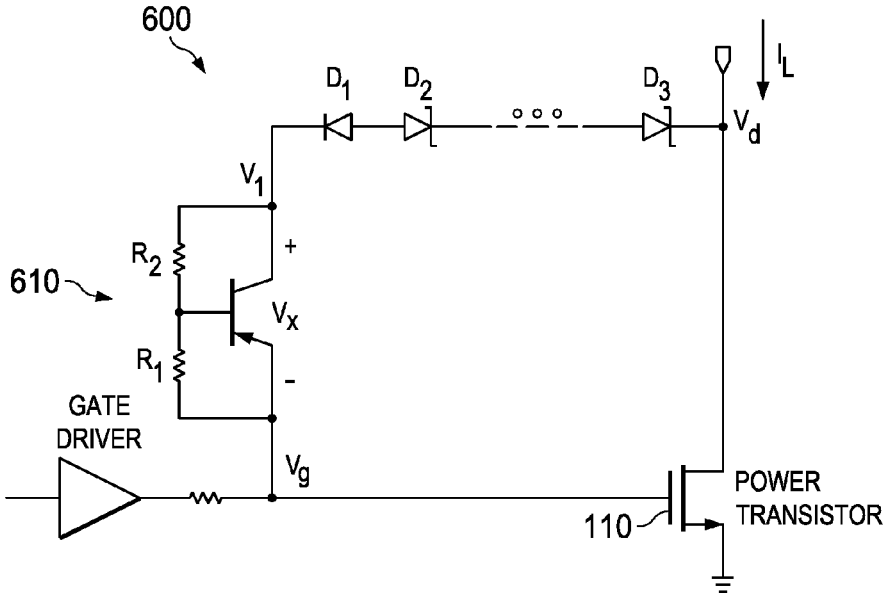
FIG. 6 is a circuit diagram of an example Vbe multiplier active clamping circuit used with a low-side load switch.

FIGS. 5 and 6 illustrate conventional voltage active clamping topologies using low-side switch MOSFET Drain to Gate or Drain to Source voltage clamping for driving an inductive load. The example topology 500 of FIG. 5 utilizes stacked Zener diodes 510. The example topology 600 of FIG. 6 utilizes a Vbe multiplier 610 (e.g., an active multiplier). Unfortunately, these topologies can exhibit large clamped voltage value variation as a result of manufacturing processes of the components used therein.

Figure 7:
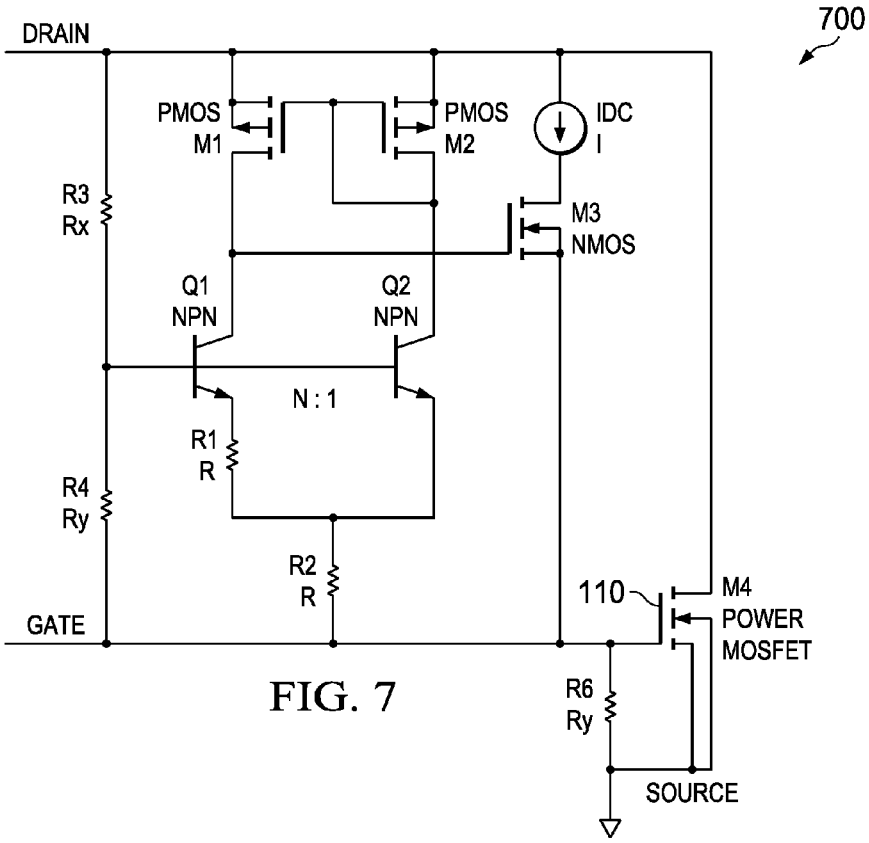
FIG. 7 is a circuit diagram of an example Brokaw bandgap active clamping circuit used with a low-side load switch.

FIG. 7 is a circuit diagram of an example Brokaw bandgap active clamping circuit 700 used with a low-side MOSFET. In some examples, to achieve greater accuracy in a voltage clamped circuit, a Brokaw bandgap reference (BGR) active clamping circuit is used. The example Brokaw bandgap active clamping circuit 700 utilizes a BGR voltage with a resistor divider, which enables control of the cutoff voltage value with higher accuracy.

Figure 8:
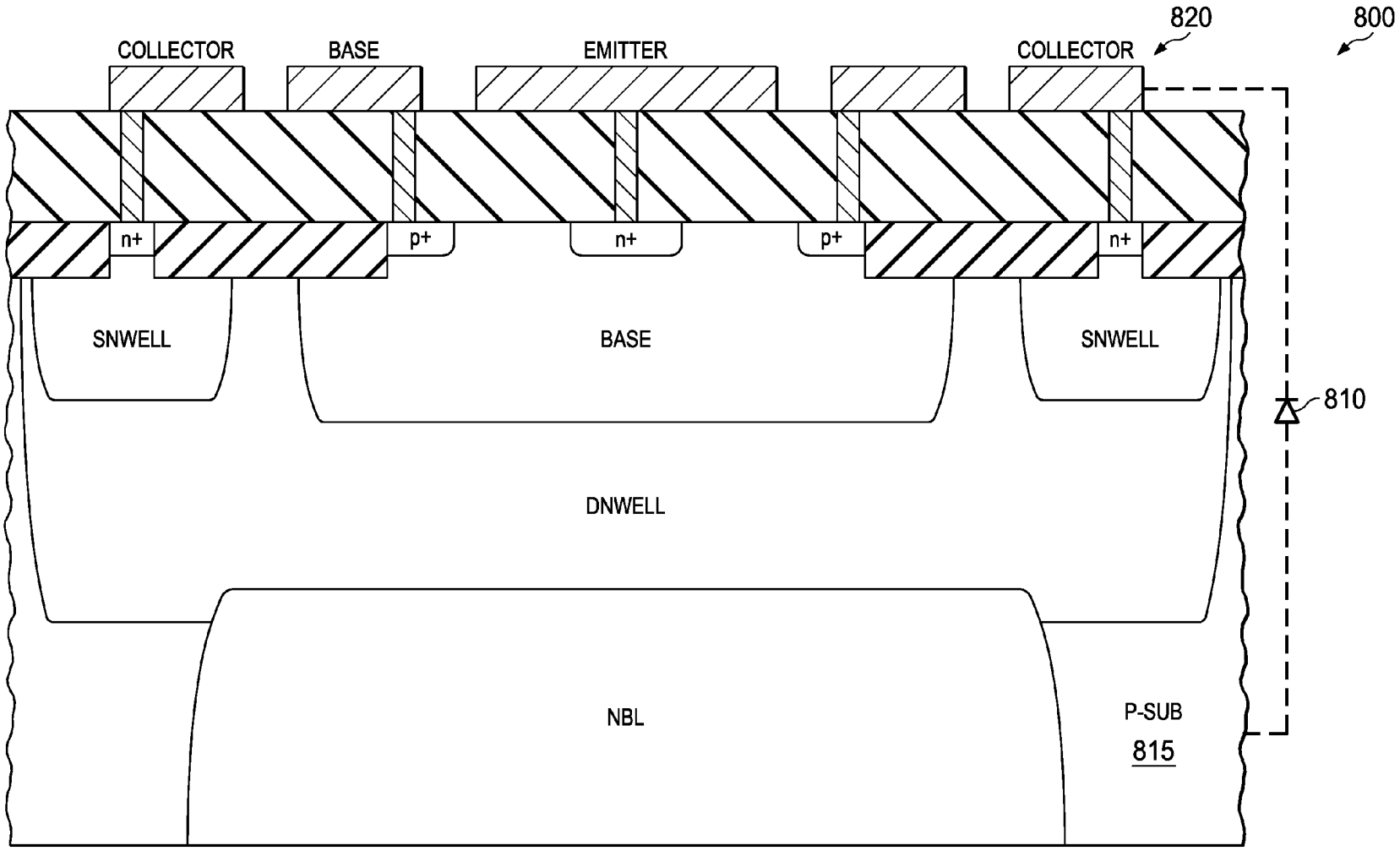
FIG. 8 is a cross-sectional view of the transistor of FIGS. 1, 3, 5, 6, and/or 7.

FIG. 8 is a cross-sectional view 800 of the transistor Zener Diode or bipolar NPN of FIGS. 5, 6, and/or 7. In the illustrated example of FIG. 8, a parasitic PN diode 810 is formed between a P-SUB substrate 815 and a bipolar NPN collector NWELL (SNWELL and DNWELL) 820 as a result of a P-Substrate manufacturing process. When used as a high-side load switch, and when the source terminal is pulled to a negative value, the gate terminal should also be set to a negative voltage value (e.g., to track to the source terminal voltage value) to protect the transistor 110 from damage. In such an implementation, the clamped collector voltage value is about −0.7V. Because of such clamping values, the Zener diode approach and/or Brokaw BGR approach used with low-side load switches described above in connection with FIGS. 5, 6, and/or 7 do not work in a high-side load switch scenario.

Figure 9:
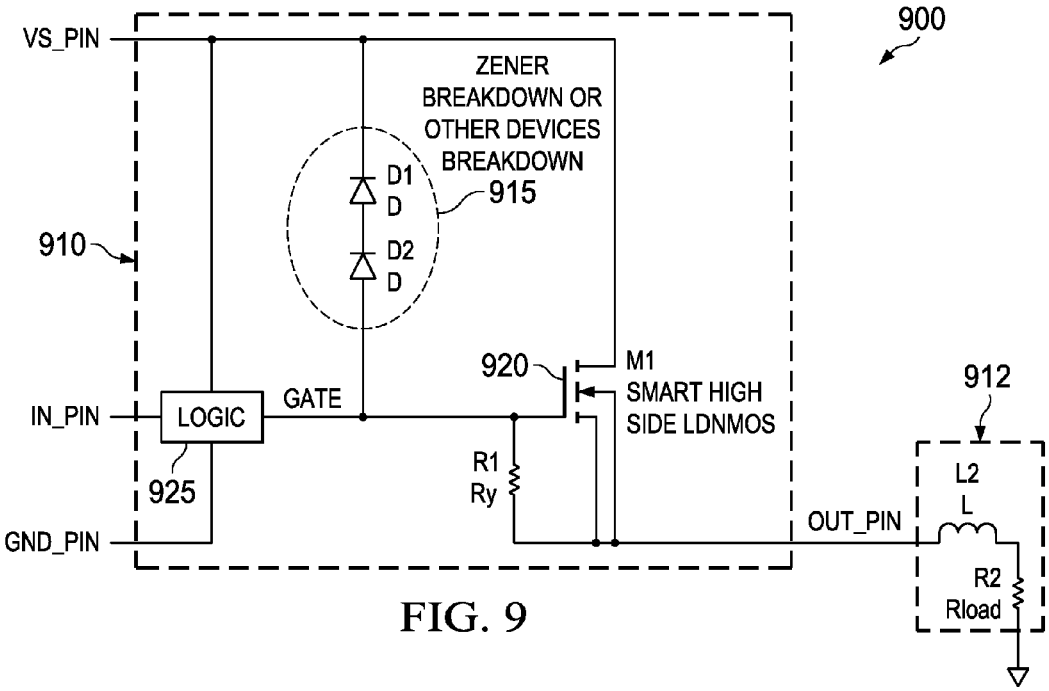
FIG. 9 is a circuit diagram of a high-side load switch driver with an inductive load.

FIG. 9 is a circuit diagram 900 of a high-side load switch 910 with an inductive load 912. In the illustrated example of FIG. 9, the high-side load switch 910 includes a negative output voltage clamping circuit 915 to facilitate driving of the inductive load 912. In the illustrated example of FIG. 9, logic 925 controls to turn on/off Power MOSFET 920. Negative voltage clamp 915 is used to limit the maximum voltage difference from a drain of the transistor 920 to a source of the transistor 920 to protect the transistor 920. With VDS clamp, a proper inductor energy could be dissipated without damaging devices.

Figure 10:
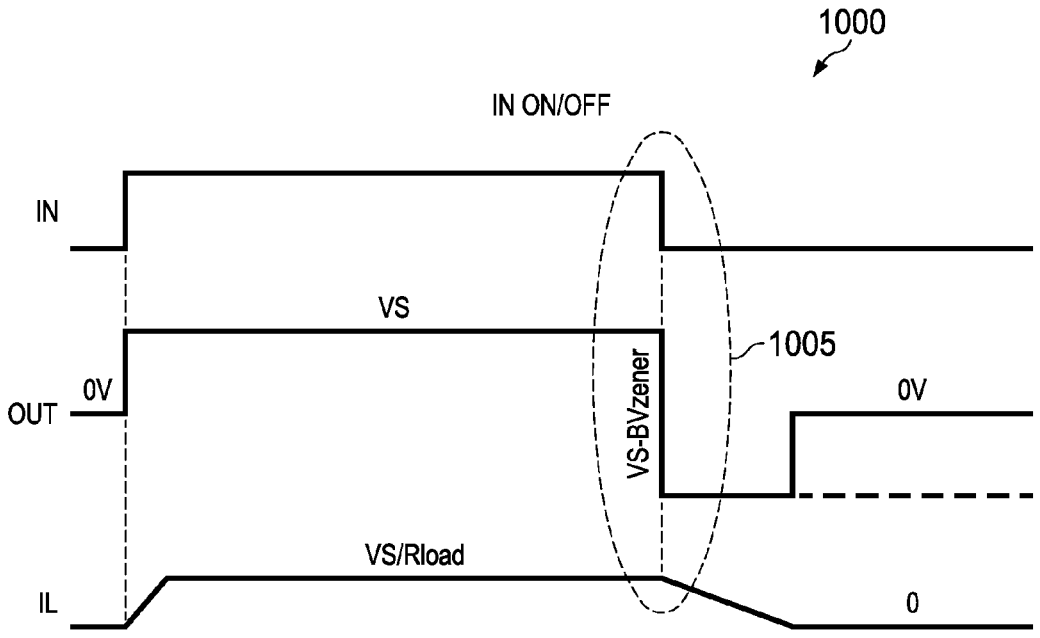
FIG. 10 is a timing diagram representing operations of the high-side load switch of FIG. 9 when the high-side load switch is turned off.

FIG. 10 is a timing diagram representing operations of the high-side load switch 910 of FIG. 9 when the high-side load switch 910 is turned from an ON state to an OFF state. When the transistor 920 is turned from an ON state to an OFF state (represented by vertical line 1005), the output voltage drops below ground potential as low as possible to achieve fast current decay.

Figure 11:
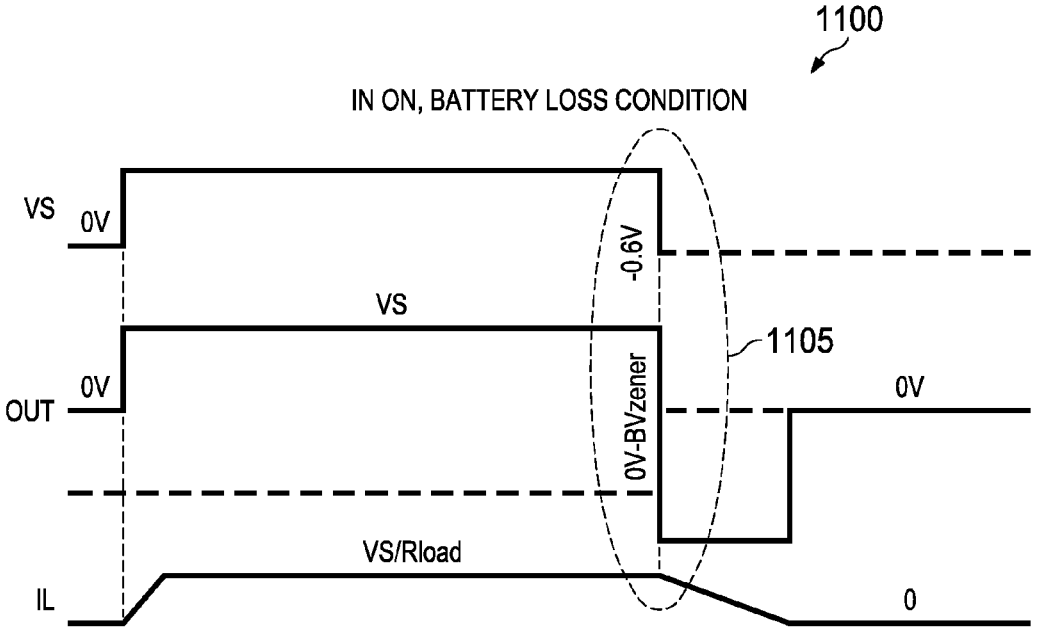
FIG. 11 is a timing diagram representing operations of the high-side load switch of FIG. 9 when a battery loss condition occurs.

FIG. 11 is a timing diagram representing operations of the high-side load switch 910 of FIG. 9 when a battery loss condition occurs. When a battery loss occurs while the transistor 920 is in an ON state (represented by vertical line 1105), the output voltage becomes as low as possible because of the inductive load 912.

To enable a negative output voltage clamping, prior approaches such as the approach of FIG. 9 are based on higher breakdown voltage Zener (based on N-substrate Vertical DMOS process) or with lower level breakdown PMOS. Such approaches result in large voltage variation as a result of manufacturing processes used to create such components. Larger breakdown voltage variation, results in larger Power MOSFET demagnetization energy capability variations.

Example approaches disclosed herein utilize a floating bandgap voltage value and a resistor divider circuit to control a voltage clamping value with higher accuracy than prior solutions. As a result of a more accurate voltage clamping value, transistors having a lower level breakdown can be used, thereby enabling reductions in size of such transistors. Using smaller transistors reduces the amount of space required, thereby enabling creation of more compact load switches. Using approaches disclosed herein, demagnetization energy capabilities of the transistor can be better controlled. Moreover, the approaches disclosed herein can also be extended for use with low-side load switch Drain to Gate/Source voltage clamps.

Figure 12:
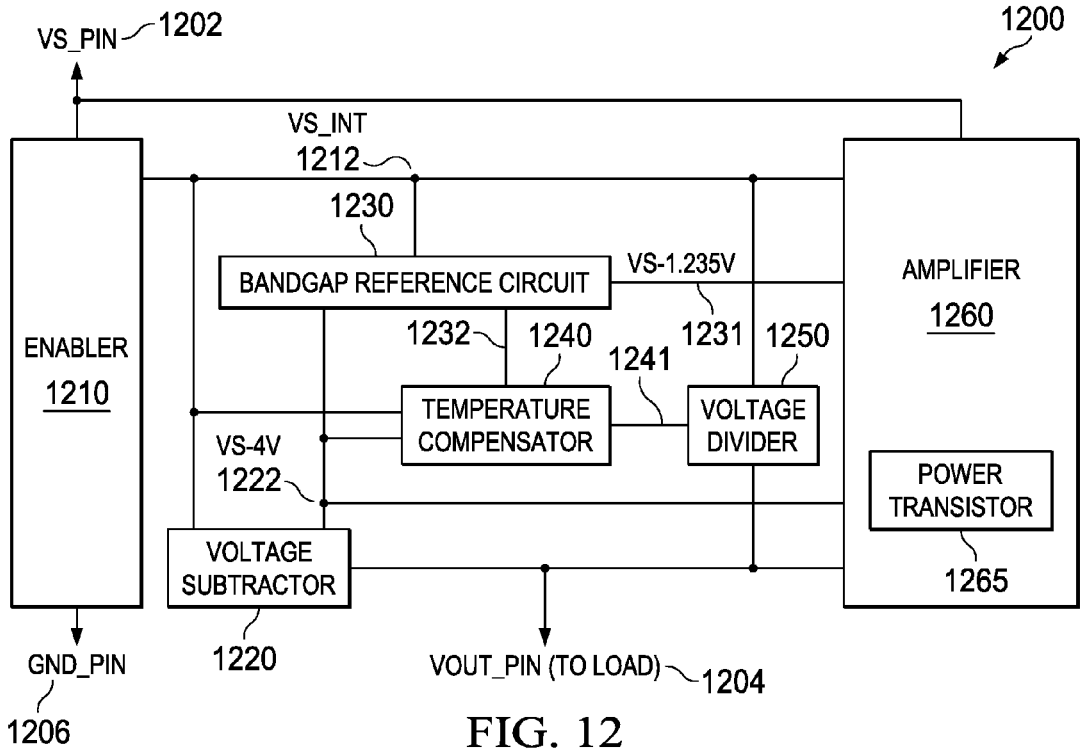
FIG. 12 is a block diagram of an example load switch for performing negative output voltage active clamping using a floating bandgap reference and temperature compensation.

FIG. 12 is a block diagram of an example load switch 1200 constructed in accordance with the teachings of this disclosure for performing negative output voltage active clamping using a floating bandgap reference and temperature compensation. In the illustrated example of FIG. 12, the example load switch 1200 is a high-side load switch that receives a voltage from a source via a VS_PIN terminal 1202, and outputs a voltage to a load via a VOUT_PIN terminal 1204. In the illustrated example of FIG. 12, the example load switch 1200 is connected to a ground via a GND_PIN terminal. The example load switch 1200 includes an enabler 1210, a voltage subtractor 1220, a bandgap reference circuit 1230, a temperature compensator 1240, a voltage divider 1250, and an amplifier 1260. In examples disclosed herein, the amplifier 1260 includes a power transistor 1265 that functions as a switch between the VS_PIN terminal 1202 and the VOUT_PIN terminal 1204.

Figure 13:
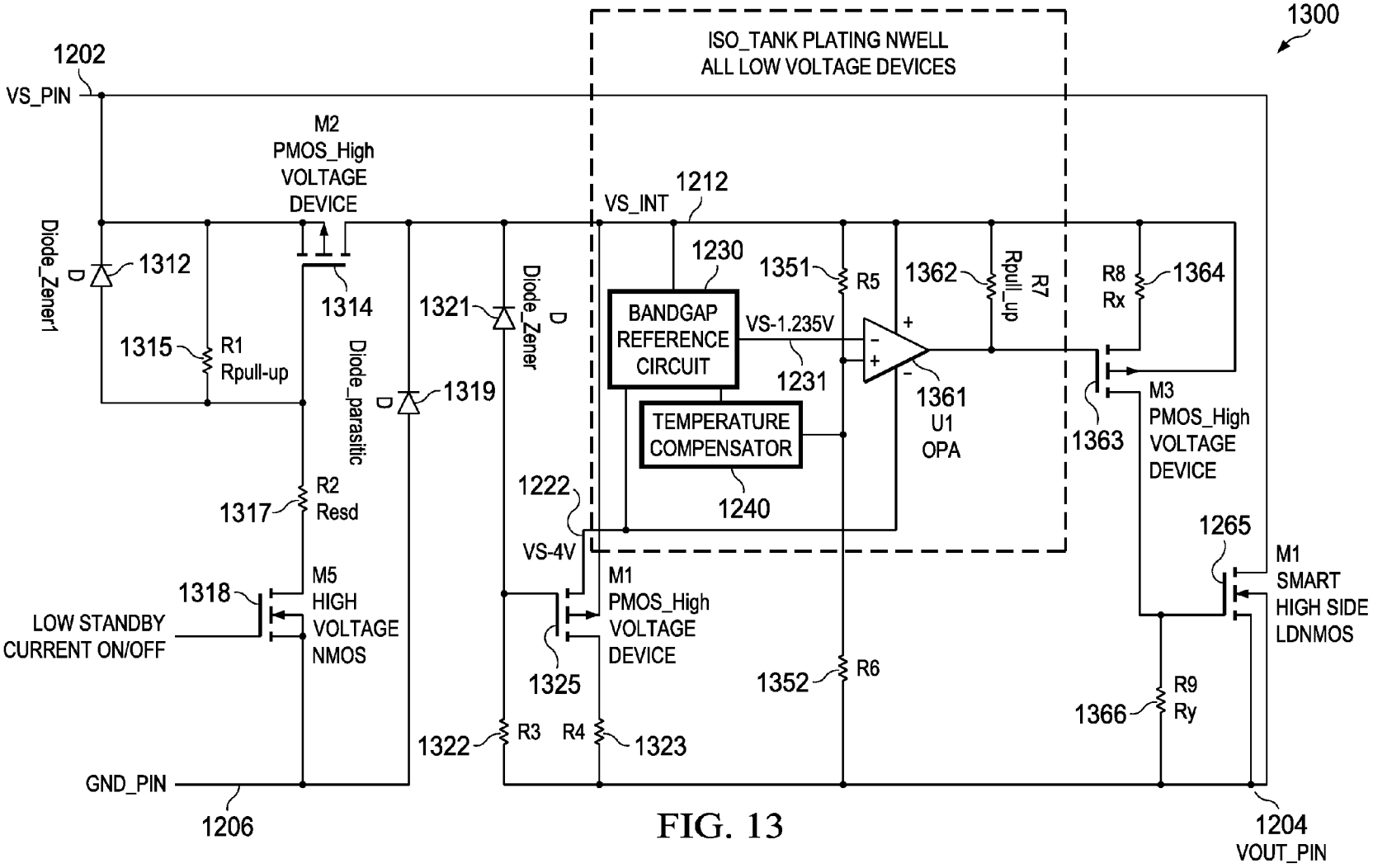
FIG. 13 is a circuit diagram representative of the example load switch of FIG. 12 for performing negative output voltage active clamping using a floating bandgap reference and temperature compensation.

FIG. 13 is a circuit diagram 1300 representative of an example implementation of the example load switch 1200 of FIG. 12 for performing negative output voltage active clamping using a floating bandgap reference and temperature compensation.

The example enabler 1210 of the illustrated example of FIG. 12 enables or disables the load switch 1200. In examples disclosed herein, the example enabler 1210 of FIG. 12 is implemented by a first diode 1312, a first transistor 1314, a first resistor 1315, a second resistor 1317, and a second transistor 1318. However, the example enabler 1210 may be implemented in any other fashion. In examples disclosed herein, the example first diode 1312 is a Zener diode. The example first transistor 1314 is implemented using a p-channel MOS (PMOS) transistor. However, any other transistor type and/or configuration may additionally or alternatively be used. The example second transistor 1318 is implemented using an n-channel MOS(NMOS) transistor. However, any other transistor type and/or configuration may additionally or alternatively be used.

In the illustrated example of FIG. 13, a cathode of the diode 1312, a first terminal of the first example transistor 1314, and a first terminal of the first resistor 1315 are connected to the terminal VS_PIN 1202. An anode of the diode 1312, a second terminal of the first example transistor 1314, and a second terminal of the first resistor 1315 are connected to a first terminal of the second resistor 1317. A third terminal of the first transistor 1314 provides an output VS_INT 1212 to the example voltage subtractor 1220, the example bandgap reference circuit 1230, the example voltage divider 1250, and the example amplifier 1260.

A second terminal of the second resistor 1317 is connected to a first terminal of the second transistor 1318. A second terminal of the second transistor 1318 receives an on/off signal to enable or disable the load switch 1200. A third terminal of the second transistor 1318 is connected to the terminal GND_PIN 1206.

In the illustrated example of FIG. 13, the first terminal of the first example transistor 1314 is a source terminal, the second terminal of the first example transistor 1314 is a gate terminal, and the third terminal of the first example transistor 1314 is a drain terminal. A fourth terminal of the first example transistor 1314 is a body terminal, and is connected to source terminal. In the illustrated example of FIG. 13, the first terminal of the second example transistor 1318 is a drain terminal, the second terminal of the second example transistor 1318 is a gate terminal, and the third terminal of the second example transistor 1318 is a source terminal. A fourth terminal of the second example transistor 1318 is a body terminal, and is connected to the third terminal of the second example transistor 1318 (e.g., the source). However, any other past, present, and/or future type of transistor and/or terminal naming conventions may additionally or alternatively be used.

In the illustrated example of FIG. 13, a cathode of a second diode 1319 is connected to the third terminal of the first transistor 1314, and an anode of the second diode 1319 is connected to the third terminal of the second transistor 1318. The second diode 1319 is referred to as a parasitic diode from 1212 VS_INT isolation NWELL to P-substrate.

The example voltage subtractor 1220 of the illustrated example of FIG. 12 provides a voltage VS−4V 1222 to the bandgap reference circuit 1230 and the amplifier 1260. In the illustrated example of FIG. 13, the example voltage subtractor 1220 is implemented using a third diode 1321, a third resistor 1322, a fourth resistor 1323, and a third transistor 1325. In examples disclosed herein, the third diode 1321 is a Zener diode. However, any other type of diode and/or circuit may additionally or alternatively be used. In the illustrated example of FIG. 13, a cathode of the third diode 1321 is connected to VS_INT 1212. An anode of the third example diode 1321 is connected to a first terminal of the third example resistor 1322 and a first terminal of the third example transistor 1325. A second terminal of the third example transistor 1325 is connected to a first terminal of the fourth example resistor 1323. A second terminal of the third example resistor 1322 is connected to a second terminal of the fourth example resistor 1323 and the terminal VOUT_PIN 1204. A third terminal of the third example transistor 1325 is connected to VS_INT 1212. A fourth terminal of the third example transistor 1325 outputs the voltage VS−4V 1222 to the example bandgap reference circuit 1230 and the example amplifier 1260.

In the illustrated example of FIG. 13, the third example transistor is implemented using a p-channel MOS (PMOS) transistor. However, any other transistor type and/or configuration may additionally or alternatively be used. In the illustrated example of FIG. 13, the first terminal of the third example transistor 1325 is a gate, the second terminal of the third example transistor 1325 is a drain, the third terminal of the third example transistor 1325 is a body, and the fourth terminal of the third example transistor 1325 is a source. However, any other past, present, and/or future transistor type and/or configuration and/or terminal naming convention may additionally or alternatively be used.

As noted above, the fourth terminal of the third example transistor outputs the voltage VS−4V 1222. A voltage difference between VS_INT 1212 and VS−4V 1222 is equal to the difference between the breakdown voltage of the third diode 1321 and the voltage across the first terminal of the third example transistor 1325 (e.g., the gate) and the second terminal of the third example transistor 1325 (e.g., the source).

The example bandgap reference circuit 1230 of the illustrated example of FIG. 12 receives VS_INT 1212 and VS−4V 1222. The example bandgap reference circuit 1230 outputs VS−1.235V 1231 to the amplifier 1260. The example bandgap reference circuit 1230 outputs an enable signal 1232 to the temperature compensator 1240. The example bandgap reference circuit 1230 of FIG. 12 generates a floating voltage reference against VS_INT. The BGR output voltage value is maintained at VS_INT minus 1.235V (VS_INT−1.235v). The example bandgap reference circuit 1230 operates during a battery loss condition (e.g., without a supply voltage input) with an inductive load because the inductive load maintains an output current, which acts to pull down VOUT_PIN 1204 and VS_PIN 1202. In examples disclosed herein, VS_PIN 1202 is clamped at a first threshold voltage (e.g., 0V−0.7V representing one diode voltage drop vs. P-Sub:0V). In examples disclosed herein, when the voltage across VS_PIN 1202 and VOUT_PIN 1204 voltage value is larger than a second threshold voltage (e.g., 4V), the bandgap reference circuit 1230 becomes enabled. An example implementation of the bandgap reference circuit 1230 is disclosed in further detail in connection with FIG. 14, below.

The example temperature compensator 1240 of the illustrated example of FIG. 12 injects a temperature compensation current ($I_{PTAT}$) 1241 into the voltage divider 1250. In examples disclosed herein, the temperature compensation current is proportional to absolute temperature (PTAT). However, any other type of temperature compensation current may additionally or alternatively be used such as, for example, a temperature compensation current that is complementary to absolute temperature (CTAT). In examples disclosed herein, the example temperature compensator receives VS_INT 1212 and VS−4V 1222. The example temperature compensator 1240 receives the enable signal 1232 from the bandgap reference circuit 1230. In examples disclosed herein, the temperature compensation current ($I_{PTAT}$) 1241 output to the voltage divider increases or decreases with temperature. In such a manner, the voltage across VS_INT 1212 and VOUT_PIN 1204 likewise increases or decreases with temperature, enabling compensation for temperature-dependent operational characteristics of the power transistor 1265. In some examples, the power transistor 1265 is implemented by a circuit having a large temperature coefficient, which causes a breakdown voltage of the transistor 1265 to vary with temperature (e.g., 30 mV/C, resulting in approximately a 2V range in the breakdown voltage over a temperature range of 27 C to −40 C). Using temperature compensation provided by the temperature compensator mitigates a risk that the breakdown voltage of the transistor 1265 will be reached. An example implementation of the temperature compensator 1240 is disclosed in further detail in connection with FIG. 14, below.

The example voltage divider 1250 of the illustrated example of FIG. 12 divides the voltage across VS_INT 1212 and VOUT_PIN 1204, and provides the divided voltage to the amplifier 1260. In the illustrated example of FIG. 13, the example voltage divider is implemented using a fifth resistor 1351 and a sixth resistor 1352. A first terminal of the fifth resistor 1351 is connected to VS_INT 1212. A second terminal of the fifth resistor 1351 is connected to a first terminal of the sixth resistor 1352. A second terminal of the sixth resistor 1352 is connected to VOUT_PIN 1204. In the illustrated example of FIG. 13, the second terminal of the fifth resistor 1351 and the first terminal of the sixth resistor 1352 receive the temperature compensation current ($I_{PTAT}$) 1241 from the temperature compensator 1240. The second terminal of the fifth resistor 1351 and the first terminal of the sixth resistor 1352 provide an output to the amplifier 1260. In the illustrated example of FIG. 13, the fifth example resistor 1351 is represented as R5 and the sixth example resistor 1352 is represented as R6. In examples disclosed herein, the output voltage across the fifth example resistor 1251 is provided to the example amplifier 1260.

The example amplifier 1260 of the illustrated example of FIG. 12 is implemented by a three stage amplifier. However, any other type of amplifier and/or amplification circuit may additionally or alternatively be used. In the illustrated example of FIG. 13, a first stage of the example amplifier 1260 is implemented by an operational amplifier 1361. A first terminal of the operational amplifier 1361 receives VS−1.235V from the example bandgap reference circuit 1230. A second terminal of the operational amplifier 1361 is connected to the second terminal of the fifth resistor 1351 of the voltage divider 1250. A third terminal of the example operation amplifier receives the voltage VS−4V 1222. A fourth terminal of the operational amplifier receives the voltage VS_INT 1212. A fifth terminal of the operational amplifier is connected to a first terminal of a fourth transistor 1363 and a first terminal of a seventh resistor 1362. A second terminal of the seventh resistor 1362 is connected to VS_INT 1212.

A second stage of the example amplifier 1260 is implemented by the fourth transistor 1363. The example fourth transistor 1363 is implemented using a p-channel MOS (PMOS) transistor. However, any other transistor type and/or configuration may additionally or alternatively be used. As noted above, the first terminal of the fourth example transistor 1363 is connected to the fifth terminal of the operational amplifier 1361 and the first terminal of the seventh resistor 1362. A second terminal of the fourth example transistor 1363 is connected to a first terminal of an eighth resistor 1364. A second terminal of the example eighth resistor 1362 is connected to VS_INT 1212. A third terminal of the fourth example transistor 1363 is connected to VS_INT 1212. A fourth terminal of the fourth example transistor 1363 is connected to a first terminal of the power transistor 1265 and a first terminal of a ninth resistor 1366. In the illustrated example of FIG. 13, the first terminal of the fourth example transistor 1363 is a gate, the second terminal of the fourth example transistor 1363 is a source, the third terminal of the fourth example transistor 1363 is a body, and the fourth terminal of the fourth example transistor 1363 is a drain. However, any other past, present, and/or future type of transistor and/or terminal naming conventions may additionally or alternatively be used.

A third stage of the example amplifier 1260 is implemented by the power transistor 1265. As noted above, the power transistor 1265 is implemented by a lateral double diffused NMOSFET (LDNMOS). However, any other type of transistor may additionally or alternatively be used. As noted above, a first terminal of the power transistor 1265 is connected to a first terminal of the ninth example resistor 1366 and the fourth terminal of the fourth example transistor 1363. A second terminal of the ninth example resistor 1366 is connected to VOUT_PIN 1204. A second terminal of the power transistor 1265 is connected to VS_PIN 1202. A third terminal of the power transistor 1265 is connected to VOUT_ PIN 1204. A fourth terminal of the power transistor 1265 is connected to VOUT_PIN 1204. In the illustrated example of FIG. 13, the first terminal of the power transistor 1265 is a gate, the second terminal of the power transistor 1265 is a drain, the third terminal of the power transistor 1265 is a body, and the fourth terminal of the power transistor 1265 is a source. However, any other transistor using any other past, present, and/or future terminal configuration and/or naming convention may additionally or alternatively be used.

In the illustrated example of FIG. 12, the amplifier 1260, the voltage divider 1250, and the bandgap reference circuit 1230 together function as a closed loop. In examples disclosed herein, the closed loop force voltage across the fifth resistor 1351 (of the voltage divider) is equal to VS−1.235V. In other words, [VS−(VS−1.235V)]=(VS_INT−VOUT_PIN)*R5/(R5+R6), VS_VIN−VOUT=1.235*(R5+R6)/R5.

Figure 14:
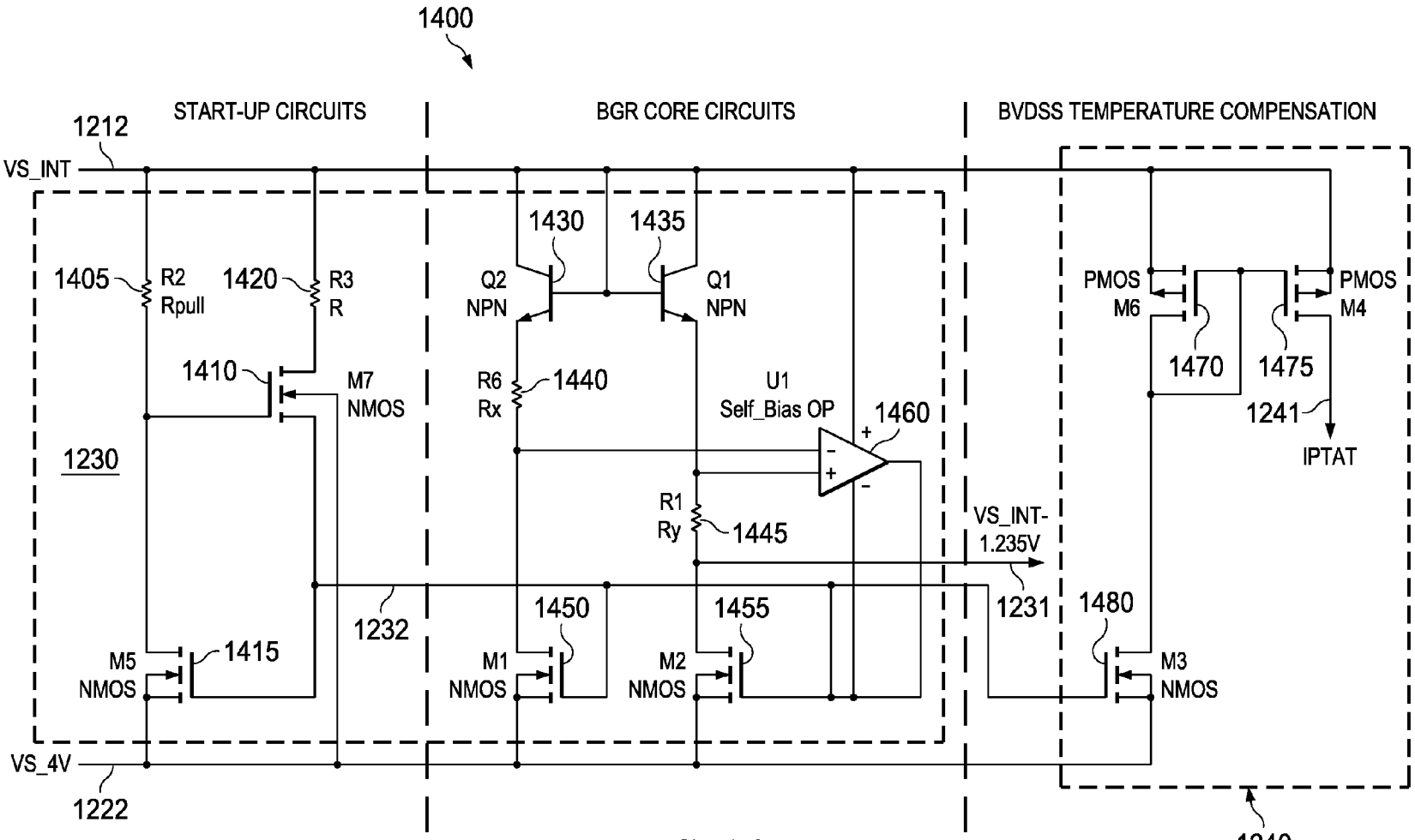
FIG. 14 is a circuit diagram representing the floating bandgap reference circuit and temperature compensator of the load switch of FIGS. 12 and/or 13.

FIG. 14 is a circuit diagram representing the bandgap reference circuit 1230 and temperature compensator 1240 of the load switch 1200 of FIGS. 12 and/or 13. The example bandgap reference circuit 1230 of FIG. 14 includes a first resistor 1405, a first transistor 1410, a second transistor 1415, a second resistor 1420, a third transistor 1430, a fourth transistor 1435, a third resistor 1440, a fourth resistor 1445, a fifth transistor 1450, a sixth transistor 1455, and an operational amplifier 1460. The example temperature compensator 1240 of the illustrated example of FIG. 14 includes a seventh transistor 1470, an eighth transistor 1475, and a ninth transistor 1480.

A first terminal of the first resistor 1405 is connected to VS_INT 1212. A second terminal of the first resistor 1405 is connected to a first terminal of the first transistor 1410 and a first terminal of the second transistor 1415.

In the illustrated example of FIG. 14, the first transistor 1410 is implemented using an n-channel MOS(NMOS) transistor. However, any other transistor type and/or configuration may additionally or alternatively be used. The first terminal of the first transistor 1410 is connected to the second terminal of the first resistor 1405 and the first terminal of the second transistor 1415. A second terminal of the second transistor 1410 is connected to a first terminal of the second resistor 1420. A third terminal of the first transistor 1410 is connected to VS−4V 1222. A fourth terminal of the second transistor 1410 is connected to a second terminal of the third transistor 1415, a first terminal of the fifth transistor 1450, a first terminal of the sixth transistor 1455, the fifth terminal of the operational amplifier 1460, and a first terminal of the ninth transistor 1480. In examples disclosed herein, the first terminal of the first example transistor 1410 is a gate, the second terminal of the first example transistor 1410 is a drain, the third terminal of the first example transistor 1410 is a body, and the fourth first terminal of the first example transistor 1410 is a source. However, any other transistor using any other past, present, and/or future terminal configuration and/or naming convention may additionally or alternatively be used.

In the illustrated example of FIG. 14, the second transistor 1415 is implemented using an n-channel MOS(NMOS) transistor. However, any other transistor type and/or configuration may additionally or alternatively be used. The first terminal of the second transistor 1415 is connected to the second terminal of the first resistor 1405 and the first terminal of the first transistor 1410. A second terminal of the second transistor 1415 is connected to the fourth terminal of the first transistor 1410, the first terminal of the fifth transistor 1450, the first terminal of the sixth transistor 1455, the fifth terminal of the operational amplifier 1460, and the first terminal of the ninth transistor 1480. A third terminal of the second transistor 1415 and a fourth terminal of the second transistor 1415 are connected to VS−4V 1222. In examples disclosed herein, the first terminal of the second example transistor 1415 is a drain, the second terminal of the second example transistor 1415 is a gate, the third terminal of the second example transistor 1415 is a body, and the fourth first terminal of the second example transistor 1415 is a source. However, any other transistor using any other past, present, and/or future terminal configuration and/or naming convention may additionally or alternatively be used.

The first terminal of the second example resistor 1420 is connected to the second terminal of the first example transistor 1410. A second terminal of the second resistor 1420 is connected to VS_INT 1212.

In some examples, the first example resistor 1405, the first transistor 1410, the second example transistor 1415, and the second example resistor 1420 are referred to as a start-up circuit. In operation, the first example resistor 1405, the first transistor 1410, the second example transistor 1415, and the second example resistor 1420 determine whether the difference between VS_INT 1212 and VS−4V is larger than a threshold voltage (e.g., about 4V), and outputs a corresponding enable signal 1232 to enable further operations of the bandgap reference circuitry 1230 and operations of the example temperature compensator 1240.

The third example transistor 1430 of the illustrated example of FIG. 14 is implemented by a bipolar junction transistor (BJT). The fourth example transistor 1435 of the illustrated example of FIG. 14 is implemented by a BJT. In the illustrated example of FIG. 14, the third example transistor 1430 and the fourth example transistor 1435 are bipolar NPN transistors. However, any other transistor type(s) and/or configuration(s) may additionally or alternatively be used. A first terminal of the third example transistor 1430 is connected to VS_INT 1212. A first terminal of the fourth example transistor 1435 is connected to VS_INT 1212. A second terminal of the third example transistor 1430 is connected to VS_INT 1212 and a second terminal of the fourth example transistor 1435. A third terminal of the third example transistor 1430 is connected to a first terminal of the third resistor 1440. A third terminal of the fourth example transistor is connected to a first terminal of the fourth resistor 1445 and a first terminal of the operational amplifier 1460.

In the illustrated example of FIG. 14, the first terminal of the third example transistor 1430 is a collector, the second terminal of the third example transistor 1430 is a base, and the third terminal of the third example transistor 1430 is an emitter. The first terminal of the fourth example transistor 1435 is a collector, the second terminal of the fourth example transistor 1435 is a base, and the third terminal of the fourth example transistor 1435 is an emitter. However, any other transistor using any other past, present, and/or future terminal configuration and/or naming convention may additionally or alternatively be used.

The first terminal of the fourth example resistor 1440 is connected to the third terminal of the third example transistor 1430. A second terminal of the fourth example resistor is connected to a second terminal of the operational amplifier 1460 and a second terminal of the fifth transistor 1450.

The first terminal of the fifth example resistor 1445 is connected to the first terminal of the operational amplifier 1460 and the third terminal of the fourth example transistor 1435. A second terminal of the fifth example resistor 1445 is connected to a second terminal of the sixth example transistor 1455 and VS−1.235V 1231.

In the illustrated example of FIG. 14, the fifth example transistor 1450 is implemented using an n-channel MOS (NMOS) transistor. However, any other transistor type and/or configuration may additionally or alternatively be used. The first terminal of the fifth example transistor 1450 is connected to the fourth terminal of the first example transistor 1410, the second terminal of the second example transistor 1415, the first terminal of the sixth example transistor 1455, the fifth terminal of the operational amplifier 1460, and the first terminal of the ninth example transistor 1480. A second terminal of the fifth example transistor 1450 is connected to the second terminal of the third example resistor 1440 and the second terminal of the operational amplifier 1460. A third terminal and a fourth terminal of the fifth example transistor 1450 are connected to VS−4V 1222. In examples disclosed herein, the first terminal of the fifth example transistor 1450 is a gate, the second terminal of the fifth example transistor 1450 is a drain, the third terminal of the fifth example transistor 1450 is a body, and the fourth first terminal of the fifth example transistor 1450 is a source. However, any other transistor using any other past, present, and/or future terminal configuration and/or naming convention may additionally or alternatively be used.

In the illustrated example of FIG. 14, the sixth example transistor 1455 is implemented using an n-channel MOS (NMOS) transistor. However, any other transistor type and/or configuration may additionally or alternatively be used. The first terminal of the sixth example transistor 1455 is connected to the fourth terminal of the first example transistor 1410, the second terminal of the second example transistor 1415, the first terminal of the fifth example transistor 1450, the fifth terminal of the operational amplifier 1460, and the first terminal of the ninth example transistor 1480. A second terminal of the sixth example transistor 1455 is connected to the second terminal of the fourth example resistor 1445 and the output VS−1.235V 1231. A third terminal and a fourth terminal of the sixth example transistor 1455 are connected to VS−4V 1222. In examples disclosed herein, the first terminal of the fifth example transistor 1455 is a gate, the second terminal of the fifth example transistor 1455 is a drain, the third terminal of the fifth example transistor 1455 is a body, and the fourth first terminal of the fifth example transistor 1455 is a source. However, any other transistor using any other past, present, and/or future terminal configuration and/or naming convention may additionally or alternatively be used.

The operational amplifier 1460 of the illustrated example of FIG. 14 receives an input at a first terminal and a second terminal, receives power supply voltages at a third terminal and a fourth terminal, and outputs an output voltage at a fifth terminal. In the illustrated example of FIG. 14, the first terminal of the operational amplifier 1460 is connected to the second terminal of the third resistor 1440 and the second terminal of the fifth transistor 1450. The second terminal of the operational amplifier 1460 is connected to the third terminal of the fourth example transistor 1435 and the first terminal of the fourth example resistor 1445. In the illustrated example of FIG. 14, the first terminal of the operational amplifier 1460 is an inverting input and the second terminal of the operational amplifier 1460 is a non-inverting input. However, any other operational amplifier configuration may additionally or alternatively be used. The third terminal of the example operational amplifier 1460 is connected to VS_INT 1212. The fourth terminal of the example operational amplifier 1460 is connected to VS−4V 1222. The fifth terminal of the example operational amplifier 1460 is connected to the fourth terminal of the first example transistor 1410, the second terminal of the second example transistor 1415, the first terminal of the fifth example transistor 1450, the first terminal of the sixth example transistor 1455, and the first terminal of the ninth example transistor.

In some examples, the third example transistor 1430, the fourth example transistor 1435, the third example resistor 1440, the fourth example resistor 1445, the fifth example transistor 1450, the sixth example transistor 1455, and the operational amplifier 1460 are referred to as a bandgap reference core circuit. In examples disclosed herein, the bandgap reference circuit 1230 of FIG. 14 can operate under negative voltage, because the collectors of the third and fourth example transistors 1430, 1435 are connected with VS_INT 1212. In this manner, traditional issues where a Brokaw bandgap reference is not operable at a negative voltage are avoided. For example, the bipolar NPN transistors implementing the third example transistor 1430 and the fourth example transistor 1435 are not affected by the negative voltage.

As noted above, the example temperature compensator 1240 of the illustrated example of FIG. 14 includes a seventh transistor 1470, an eighth transistor 1475, and a ninth transistor 1480. The seventh example transistor 1470 and the eighth example transistor 1475 are implemented using p-channel MOS (PMOS) transistors. The ninth example transistor 1480 is implemented using an n-channel MOS (NMOS) transistor. However, any other transistor type(s) and/or configuration(s) may additionally or alternatively be used.

In the illustrated example of FIG. 14, a first terminal of the sixth example transistor 1470 is connected to VS_INT 1212. A second terminal of the sixth example transistor 1470 is connected to VS_INT 1212. Likewise, a first terminal of the seventh example transistor 1475 is connected to VS_INT 1212 and a second terminal of the seventh example transistor 1475 is connected to VS_INT 1212. A third terminal of the sixth example transistor 1470 is connected to a fourth terminal of the sixth example transistor 1470, a third terminal of the seventh example transistor 1475, and a second terminal of the ninth example transistor 1480. A fourth terminal of the eighth transistor 1475 outputs the temperature compensation current ($I_{PTAT}$) 1241. However, the seventh example transistor 1470 and the eighth example transistor 1475 may be connected and/or configured in any other fashion. In the illustrated example of FIG. 14, the first terminal of the seventh example transistor 1470 is a source, the second terminal of the seventh example transistor 1470 is a body, the third terminal of the seventh example transistor 1470 is a gate, and the fourth terminal of the seventh example transistor 1470 is a drain. The first terminal of the eighth example transistor 1475 is a source, the second terminal of the eighth example transistor 1475 is a body, the third terminal of the eighth example transistor 1475 is a gate, and the fourth terminal of the eighth example transistor 1475 is a drain. However, any other transistor using any other past, present, and/or future terminal configuration and/or naming convention may additionally or alternatively be used.

As noted above, the first terminal of the ninth example transistor 1480 is connected to the fourth terminal of the first transistor 1410, the second terminal of the second transistor 1415, the first terminal of the fifth example transistor 1450, the first terminal of the sixth example transistor 1455, and the fifth terminal of the operational amplifier 1460. The second terminal of the ninth example transistor 1480 is connected to the fourth terminal of the seventh example transistor 1470, the third terminal of the seventh example transistor 1470, and the third terminal of the eighth example transistor 1475. A third terminal and a fourth terminal of the ninth example transistor are connected to VS−4V 1222. In the illustrated example of FIG. 14, the first terminal of the ninth example transistor 1480 is a gate, the second terminal of the ninth example transistor 1480 is a drain, the third terminal of the ninth example transistor 1480 is a body, and the fourth terminal of the ninth example transistor 1480 is a source. However, any other transistor using any other past, present, and/or future terminal configuration and/or naming convention may additionally or alternatively be used.

In examples disclosed herein, the example bandgap reference circuit 1230 generates a floating voltage reference (e.g., VS_INT−1.235V 1231) that tracks VS_INT 1212. In examples disclosed herein, the example temperature compensator 1240 provides a temperature compensation current ($I_{PTAT}$) 1241 to the voltage divider 1250 to adjust the resistor divider voltage (which is otherwise based on VS_INT 1212 and VOUT_PIN 1204). In operation, the bandgap reference VS_INT−1.235V 1231 is compared against the temperature compensated resistor divider voltage to determine whether to turn on the power transistor 1265.

Figure 15:
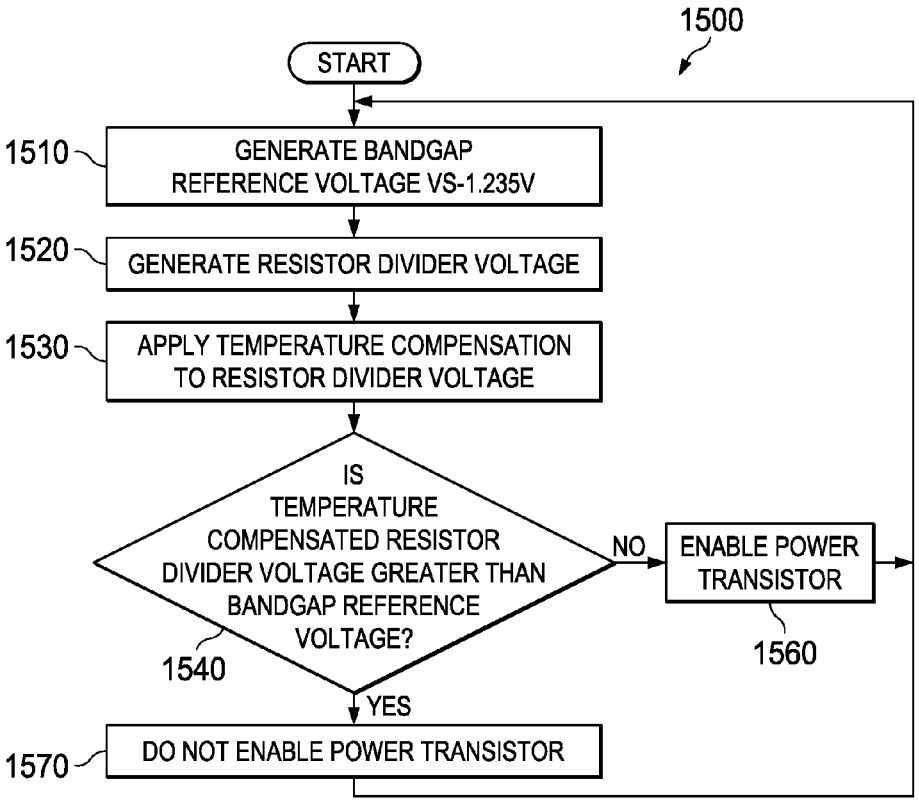
FIG. 15 is a flowchart representative of an example process implemented by the example circuit of FIGS. 13 and/or 14.

FIG. 15 is a flowchart representative of an example process 1500 implemented by the example circuit of FIGS. 13 and/or 14 to provide negative output voltage active clamping using a floating bandgap reference and temperature compensation. The example process 1500 of FIG. 15 begins when the example bandgap reference circuit 1230 generates a bandgap reference voltage (e.g., VS−1.235V 1231) (block 1510). In examples disclosed herein, the bandgap reference voltage represents a voltage that is approximately 1.235V below a source voltage (e.g., VS_INT 1212).

The example resistor divider 1250 generates a resistor divider voltage (block 1520). In examples disclosed herein, the resistor divider voltage represents a portion of a difference between the source voltage (e.g., VS_INT 1212) and an output voltage (e.g., VOUT_PIN 1204). The example temperature compensator 1240 applies a temperature compensation to the resistor divider voltage (block 1530). In examples disclosed herein, the temperature compensation is proportional to absolute temperature and is applied by injecting a temperature compensation current into the resistor divider 1250 to adjust a resistor divider ratio vs. temperature. However, any other approach to applying a temperature compensation may additionally or alternatively be used.

With temperature compensation applied, when the voltage across the drain and the source of the power transistor 1265 is greater than a threshold value (e.g., about 42.5V), the temperature compensated resistor divider voltage will be lower than the bandgap reference voltage. A first stage of the amplifier 1260 (e.g., the operational amplifier 1361 of FIG. 13) compares the temperature compensated resistor divider voltage to the bandgap reference voltage to determine whether the temperature compensated resistor divider voltage is greater than the bandgap reference voltage (block 1540). If the temperature compensated resistor divider voltage is not greater than the bandgap reference voltage (e.g., block 1540 returns a result of NO), the amplifier 1260 enables the power transistor 1265 (block 1560), and the fourth example transistor 1363 (FIG. 13) is enabled, which charges current to the gate of the power transistor 1265, thereby turning on the power transistor 1265 to avoid reaching the breakdown voltage of the power transistor 1265. The example process 1500 of FIG. 15 is then repeated.

Returning to block 1540, if the temperature compensated resistor divider voltage is greater than the bandgap reference voltage (e.g., block 1540 returns a result of YES), the amplifier 1260 does not enable the power transistor 1265 (block 1570). The example process 1500 of FIG. 15 is then repeated.

While in the illustrated example of FIG. 15, the example process 1500 is illustrated as a serial process, in practice, the operations of the load switch 1200 of FIG. 12 are performed in parallel.

From the foregoing, it will be appreciated that the above disclosed methods, apparatus and articles of manufacture enable negative output voltage active clamping using a floating bandgap reference and temperature compensation. Example approaches disclosed herein operate under negative voltage supply inputs and battery loss conditions. Moreover, temperature compensation is applied to compensate for a temperature coefficient of a power transistor drain to source break down voltage. As a result, manufacturing processes are not limited by requirements to use high breakdown voltage Zener devices or Vertical DMOS processes. Furthermore, as a result of the higher accuracy drain to source voltage clamping achieved using the approaches disclosed herein, lower level power transistors may be used. For example, while prior approaches required use of 60V power transistors to allow for wide operating ranges of clamping circuitry, approaches disclosed herein facilitate the use of lower voltage power transistors (e.g., 40V, 50V, etc.), thereby reducing the overall size of load switches implemented using the approaches disclosed herein.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A load switch comprising: a voltage source and a output node; a bandgap reference circuit coupled between the voltage source and the output node and providing a floating bandgap reference voltage; a resistor divider coupled between the voltage source and the output node and providing a resistor divider voltage; a temperature compensator coupled between the voltage source and the output node and providing a temperature compensation current to the resistor divider to provide a temperature compensated resistor divider voltage; a comparator coupled between the voltage source and the output node and having inputs coupled to the floating bandgap reference voltage and the temperature compensated resistor divider voltage, and having an output; and a power transistor coupled between the voltage source and the output node and having a control input coupled to the output of the comparator.

2. The load switch of claim 1, in which the resistor divider voltage is generated based on a voltage across a drain terminal and a source terminal of the power transistor.

3. The load switch of claim 1, in which the bandgap reference circuit is to generate the bandgap reference voltage based on a drain terminal of the power transistor and a power supply voltage.

4. The load switch of claim 1, in which the bandgap reference circuit provides an enable signal to the temperature compensator.

5. The load switch of claim 1, including a second transistor having a gate coupled to the output of the the comparator and an output coupled to the control input of the power transistor.

6. The load switch of claim 1, in which a drain of the power transistor is connected to an inductive load.

7. The load switch of claim 1, in which the power transistor is a lateral double diffused n-channel metal oxide semiconductor field effect transistor.

8. The load switch of claim 1 including an enabler coupling the voltage source to the bandgap reference circuit, the resistor divider, the temperature compensator, and the comparator.

9. A method of operating a load switch, the method comprising: generating a bandgap reference voltage from between a source voltage and a output node; generating a resistor divider voltage between the source voltage and the output node; applying a temperature compensation adjustment to the resistor divider voltage to form a temperature adjusted resistor divider voltage; comparing with a comparator the temperature compensated resistor divider voltage to the bandgap reference voltage; and in response to determining that the temperature compensated resistor divider voltage is less than the bandgap reference voltage, enabling a power transistor with an output of the comparator.

10. The method of claim 9, in which the comparing includes comparing by an operational amplifier.

11. The method of claim 10, in which the temperature compensation is proportional to absolute temperature.

12. The method of claim 9, in which the bandgap reference voltage is generated based on a voltage at a source terminal of the power transistor.

13. The method of claim 9, in which the resistor divider voltage is generated based on a voltage across a drain and a source of the power transistor.

14. The method of claim 9 including coupling the source voltage to the bandgap reference circuit, the resistor divider, and the comparator with an enabler circuit.

* * * * *